US005736660A

United States Patent [19]

Frankel

[11] Patent Number: 5,736,660

[45] Date of Patent: Apr. 7, 1998

[54] METHOD OF ADJUSTING LENGTH OF DUPLEX SCALE PORTION OF PIANO STRINGS

[76] Inventor: Daniel T. Frankel, 181 Avenue B, New York, N.Y. 10009

[21] Appl. No.: 666,130

[22] Filed: Jun. 19, 1996

[51] Int. Cl.[6] ..... G10C 3/10

[52] U.S. Cl. ..... 84/200; 84/458; 84/206; 84/209

[58] Field of Search ..... 84/200, 206, 209, 84/458, 453, DIG. 18

[56] References Cited

U.S. PATENT DOCUMENTS

| | | | |
|---|---|---|---|
| 126,848 | 5/1872 | Steinway | 84/198 |
| 1,212,304 | 1/1917 | Woods | 84/458 |

OTHER PUBLICATIONS

Franklin, "A Tuner's 10–Year Tonal Treasure Hunt," Piano Technician's Journal, May 1995, vol. 38, No. 5, pp. 24–29.

Franklin, "The Duplex Difference, Part 2," Piano Technician's Journal, Sep. 1995, vol. 38, No. 2, pp. 36–41.

*Primary Examiner*—Cassandra C. Spyrou
*Assistant Examiner*—Shih-yung Hsieh
*Attorney, Agent, or Firm*—Charles E. Bruzga

[57] ABSTRACT

The invention relates to an acoustic piano having a fretbase on which at least one fret node is supported by a fret and an adjacent node spaced from the fret node. Selected piano strings press downwardly upon the nodes and define between the nodes a duplex scale portion of the piano strings. A plate is located beneath the fretbase and is pressed downwardly by the fretbase due to pressure of the strings. The invention provides a method of moving the fretbase portion relative to the plate in a direction parallel to the piano strings. The method includes the steps of providing a force-applying tool including a mandrel portion, and a force-transmitting head having a force-transmitting surface and a surface for sliding on the plate. The tool is oriented so that a main axis of the mandrel portion angles downwardly towards a plane of the piano strings, with the force-transmitting surface abutting a force-receiving surface of the fretbase, and with the sliding surface abutting the plate. An impulse force is applied along the main axis having a downward component orthogonal to the plane and a component horizontal to the plane. A sufficient amount of the downward component of force is directed into the plate through the sliding surface so as to substantially reduce impulse force-caused friction between the fretbase and the plate.

14 Claims, 11 Drawing Sheets

METHOD OF ADJUSTING LENGTH OF DUPLEX SCALE PORTION OF PIANO STRINGS

FIELD OF THE INVENTION

The present invention relates to methods for adjusting the lengths of duplex scale portions of piano strings.

BACKGROUND OF THE INVENTION

Pianos including a duplex scale portion were first introduced to the piano industry in the latter half of the nineteenth century, as shown, for instance, in U.S. Pat. No. 126,848. The purpose of the duplex scale is to enhance the quality of piano tone by regulating segments of the so-called non-speaking portion of the piano strings so that the vibrations of such regulated segments are in harmony with the vibrations of the so-called speaking length of the strings. By adjusting the position of the moveable frets of the duplex scales, the secondary portions of certain strings may be brought in harmony with the main length of the strings, improving the purity and fullness of the tone of the instrument. However, no special tools or methods have been developed to tune the duplex scale. Although many pianos are equipped with moveable fretbases which permit the adjustment of the length of a duplex scale portion, few companies or technicians have taken the time or trouble to make the fine adjustments necessary to tune the duplex scale. Several reasons may help explain this technical impasse. First, the factory production procedures have apparently been trimmed by attrition since the flourishing days of the late nineteenth and early twentieth centuries, and the extra job of tuning the duplex scales has been either cut or assigned to other technicians who may not be sufficiently skilled in tuning. Second, in many instances the moveable fretbases are difficult to move once the strings are set above them due to the extreme downbearing pressure caused by the tension of the strings. Third, the construction of the moveable fretbases themselves provide little if any means to assist in the fine adjustment procedure.

As a result of the foregoing and other difficulties, the practice of tuning the duplex scale portion of piano strings has been almost abandoned and any benefits that could be derived from its use severely curtailed. The original method of inserting a screwdriver blade against one of the protruding frets continues to be the only means available. This method is not only difficult and inefficient, it has serious drawbacks which include possible defacing and damaging the frets as well as scarring the underlying plate on which a fretbase is supported. The use of a screwdriver for moving a fretbase is both time consuming and imprecise, requiring substantial readjustment.

OBJECTS AND SUMMARY OF THE INVENTION

It is, therefore, an object purpose of the present invention to provide improved methods of tuning duplex scales whereby duplex scales of all types may be more easily and effectively tuned with minimum effort and maximum efficiency while at the same time avoiding the disadvantages associated with prior art.

Briefly, the invention relates to an acoustic piano having a fretbase on which at least one fret node is supported by a fret and an adjacent node spaced from the fret node. Selected piano strings press downwardly upon the nodes and define between the nodes a duplex scale portion of the piano strings. A plate is located beneath the fretbase and is pressed downwardly by the fretbase due to pressure of the strings. The invention provides a method of moving the fretbase portion relative to the plate in a direction parallel to the piano strings. The method includes the steps of providing a force-applying tool including a mandrel portion, and a force-transmitting head having a force-transmitting surface and a surface for sliding on the plate. The tool is oriented so that a main axis of the mandrel portion angles downwardly towards a plane of the piano strings, with the force-transmitting surface abutting a force-receiving surface of the fretbase, and with the sliding surface abutting the plate. An impulse force is applied along the main axis having a downward component orthogonal to the plane and a component horizontal to the plane. A sufficient amount of the downward component of force is directed into the plate through the sliding surface so as to substantially reduce impulse force-caused friction between the fretbase and the plate, which significantly enhances the efficacy of the horizontal adjusting force.

BRIEF DESCRIPTION OF THE DRAWINGS

In the following detailed description, reference will be made to the attached drawings in which like reference numerals refer to like, or corresponding elements, throughout the following figures, and in which.

DETAILED DESCRIPTION OF THE PREFERRED EMBODIMENTS

In the following description, directional terms such as "vertically," "downwardly," and "horizontal" are used merely for convenience, and not in a limiting sense. This is because, as those of ordinary skill in the art will recognize, the techniques of the invention can be practiced with the strings of a piano at any orientation, although they are usually aligned horizontally to ground.

Figure 1:
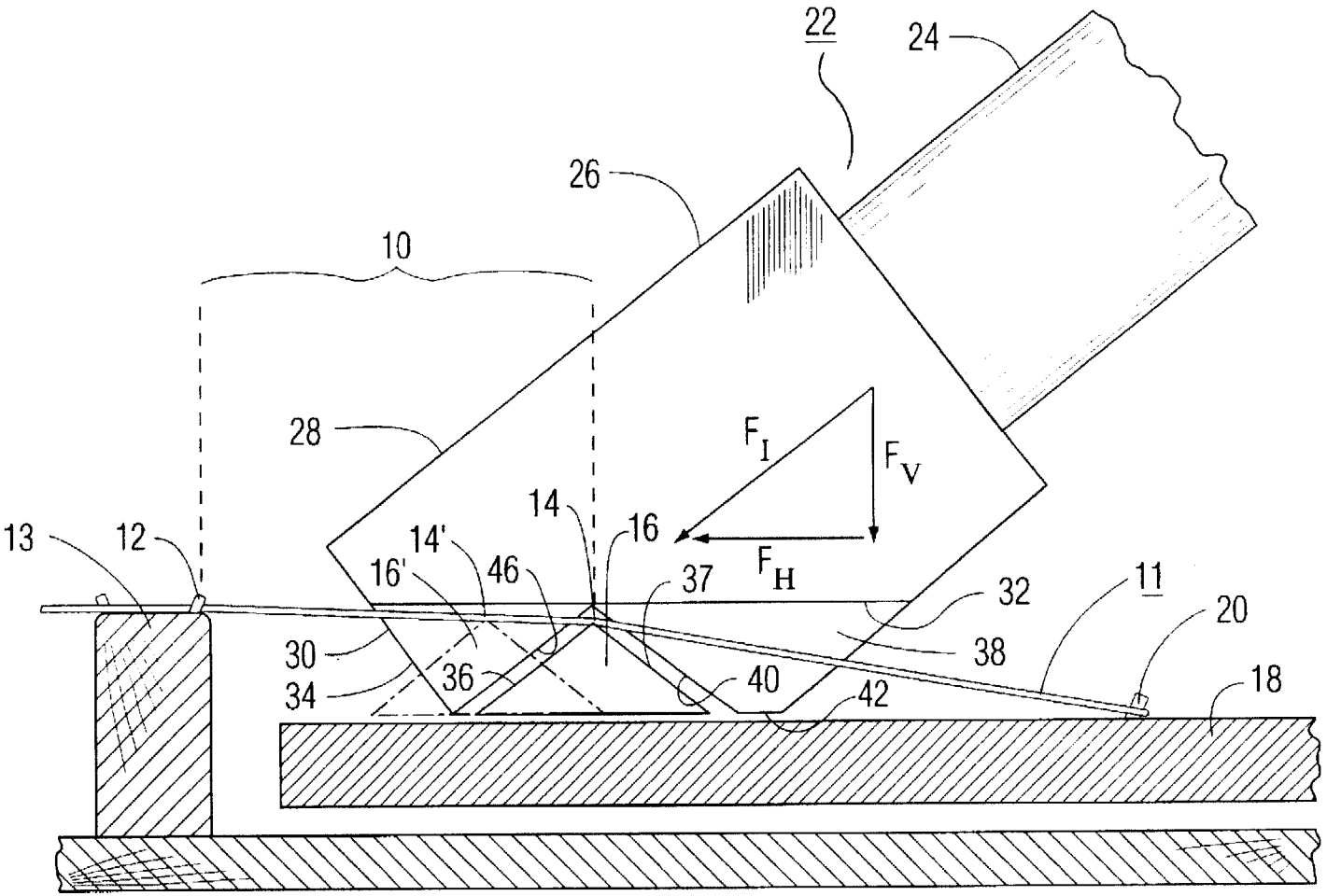
FIG. 1 is a side plan view of a piano string assembly having a tuneable rear duplex scale.

FIG. 1 is a side plan view of a contemporary grand piano string assembly showing a tuneable duplex scale segment 10 of piano strings 11. Strings 11 constitute the three strings of a so-called unison. The outer, sidebearing, soundboard bridge pin 12 is fixed and forms one node of the duplex scale string segment 10 that is tuned in accordance with the present invention. The rear node of the tuneable duplex segment 10 is the apex 14 of a moveable fret 16, generally referred to as an aliquot. Thus, the duplex scale segment 10 is the portion of piano stings 11 between nodes 12 and 14. Fret 16 is placed by visual measurement on the cast iron plate 18 between the outer sidebearing bridge pin 12 and the hitch pin 20 prior to stringing. The moveability of the fret 16 allows a technician to move the fret, for instance, to alternate position 16' shown in phantom, thereby adjusting the length of the duplex segment 10 and thereby modifying its tone. These adjustments can be made effectively and efficiently using a tool 22 shown engaged with the fret. The bottom-shown portion of fret 16 is referred to herein as a fretbase.

The tool 22 may consist of a mandrel 24 affixed to a machine tooled head 26. The head 26 consists of two sections: the body 28 which is attached to the mandrel 24 and the keel 30 which extends between and below the strings 11. Separating the body 28 and the keel 30 are shoulders 32 which are horizontal ledges cut in the body extending from the left-shown front of the tool to the right-shown rear of the tool. The shoulders 32 are cut so that the ledges overhang the strings when the tool is in position to be used. The shoulders may lightly contact the strings to guide the placement of the tool 22. The keel 30 consists of a nose 34 with a surface that contacts the front surface 36 of the fret 16 and the butt 38 that is parallel to and flush with the rear surface of the fret 16, which is a force-receiving surface 37 of the fret 16. The left-shown front surface of the butt 38 is a force-transmitting surface 40 which transfers a horizontal sliding force to the moveable fret 16 in order to adjust the position of the fret. Directly behind the force-transmitting surface 40 is a sliding surface 42 which is parallel to and in contact with the cast iron plate 18. The keel 30 is divided into two sections, the nose 34 and the butt 38. The forward (left-hand shown) plane of the nose is a holding surface 46 that secures the tool in position during the adjustment procedure.

Referring to the force diagram shown superimposed on mandrel 24, force $F_I$ is a downward angular impulse which may be analyzed as having a downward vertical force component $F_V$, and a horizontal force component $F_H$. Impulse Force $F_I$ is transmitted to the mandrel 24 by a hammer or mallet. The sliding surface 42 of the keelbutt 38 then transmits a substantial portion of the downward vertical force component $F_V$ into the cast iron plate 18. This minimizes the frictional resistance to movement between the fret 16 and the plate 18, which would be much greater if the downwardly pressing vertical force component $F_H$ were not shunted to the plate 18 in the manner described. Meanwhile, the force-transmitting surface 40 of the keelbutt 38 transmits to the force-receiving surface 37 of the fret 16 principally the horizontal force component $F_H$. The horizontal force component is rendered to its maximum efficiency because its origin is below the plane of the strings 11 and in direct line with the axis of movement of the fret. The direction of force in FIG. 1 is toward the soundboard bridge 13. As such, the force moves the node 14 of the fret 16 closer to the fixed node 12 as shown in alternate position 14' of the fret node 14, thus shortening the duplex segment 10 and raising the pitch.

Figure 2:
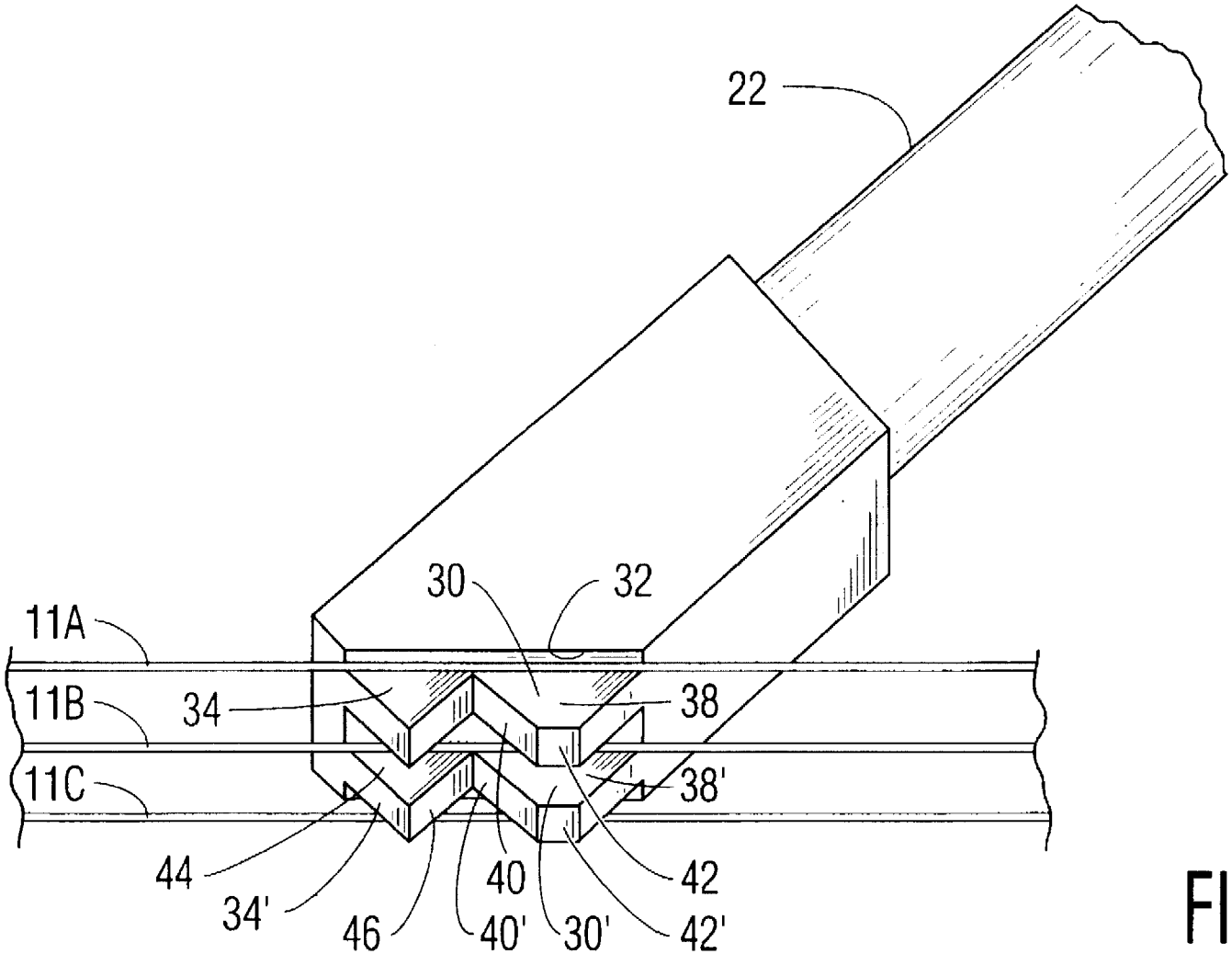
FIG. 2 shows an underside perspective of a sliding tool engaged with three strings of a unison.
Figure 3:
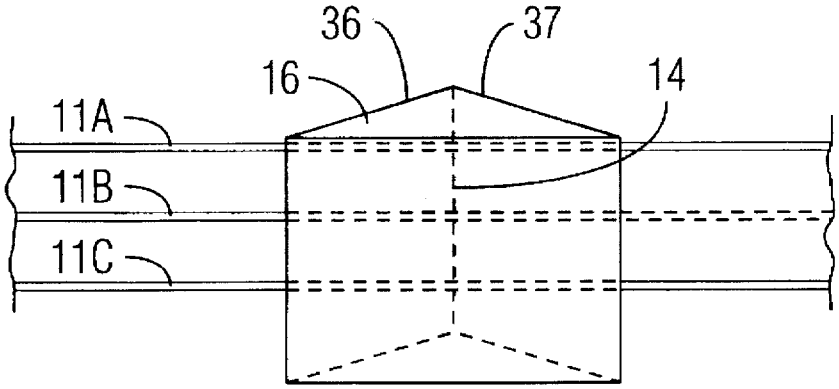
FIG. 3 is a bottom, perspective view of three strings of a unison passing across the apex of a fret.

FIG. 2 shows an underside perspective of a sliding tool 22 engaged with three strings 11A, 11B and 11C of a unison. Twin keels 30 and 30' protrude downwardly between the center string 11B and the outer strings 11A and 11C of the unison. A groove 44 between the keels 30 and 30' allows the force-transmitting surfaces of the tool 22 (FIG. 1) to contact the force-receiving surfaces of the fret 16 without any part of the tool touching the strings. The height of the groove 44 is preferably the same as the height of the shoulders 32. The effectiveness of the horizontal force component $F_H$ of the tool 22 is greatly improved by the sliding surfaces 42 and 42' on the bases of the butts 38 and 38' directly behind the force-transmitting surfaces 40 and 40'. This sliding surface 42 is preferably flush with and parallel to the surface of the cast iron plate 18, transferring the downward force component $F_V$ to the cast iron plate 18. A single fret 16 in the bottom, perspective view in FIG. 3 shows the three strings 11A, 11B and 11C of a unison passing across its apex 14. The rear surface 37 is the mentioned force-receiving surface of the moveable fret 16. The front surface 36 of the fret 16 is contacted by the holding surfaces 46 and 46' of the twin noses 34 and 34' which secure the placement of the tool during the adjustment procedure.

Figure 4:
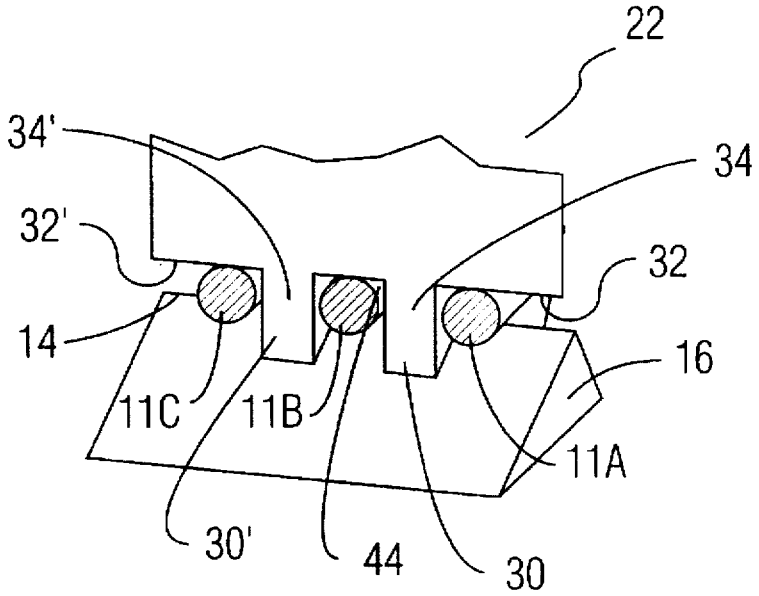
FIGS. 4 and 5 respectively show front and back views of a tool installed upon the surface of a fret together with three strings.
Figure 5:
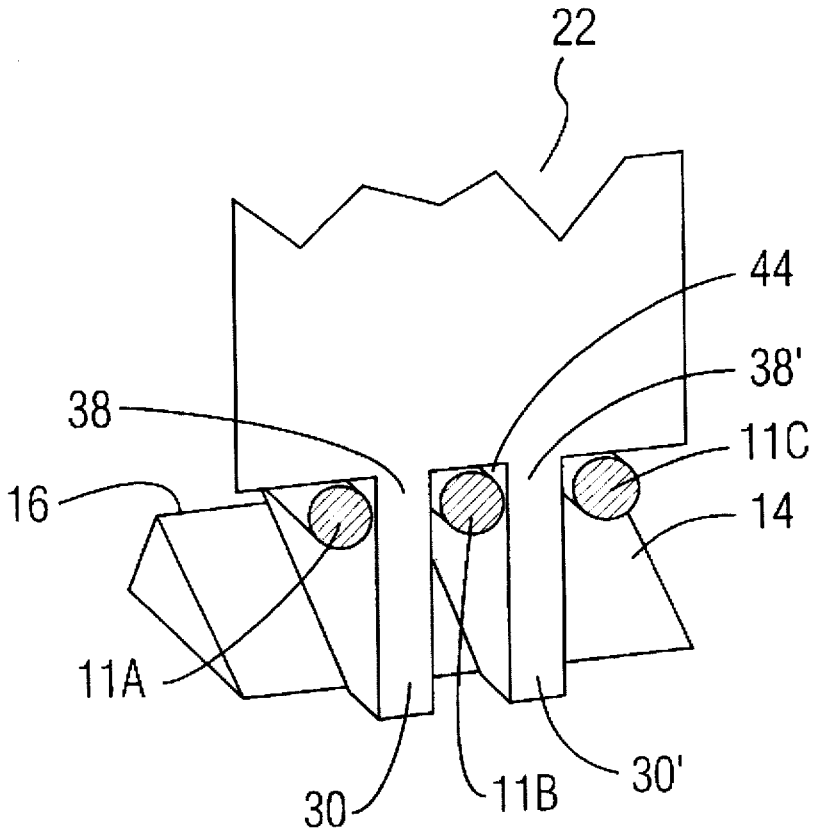

FIGS. 4 and 5 respectively show front and back views of the tool 22 installed upon the surface of a fret 16 with the strings 11A, 11B and 11C seated upon the apex 14 of a fret 16 as in the common stringing formation. The twin keels 30 and 30' extend below the strings toward the cast iron plate 18. The shoulders 32 and 32' overhang the outside strings 11A and 11C. The center string 11B passes through a groove 44 between the twin keels 30 and 30', allowing the force-transmitting surfaces 40 and 40' (FIG. 2) to be placed against the inclined surface 37 of the fret 16 without any part of the tool touching the strings. FIG. 4 shows the twin keel noses 34 and 34' placed upon the front surface 36. FIG. 5 shows the reverse view of the keel butt 38 pressed firmly against the inclined force-receiving surface 37 exerting equal and constant pressure against both sides of the center string 11B.

The tool position of FIG. 1 may be reversed in its left-to-right position and the same procedure performed but moving the fret 16 toward the hitchpin 20, thereby lengthening the duplex segment 10 and lowering the pitch. In both positions there is a tendency for the head of the tool 26 to rise as the horizontal force component $F_H$ is exerted through the force-transmitting surface of the tool 40 to the force-receiving surfaces 36 and 37; this is due to the inclined angle of the surfaces. Such tendency to rise may be neutralized by pressing the nose of the tool 34 downward against the opposite surface 36 or 37 which does not receive the horizontal force component $F_H$. For moving fret 16 to position 16' as shown in FIG. 1, by a person facing the apparatus as oriented in that figure, such downward pressing may be realized by a torque exerted upon the mandrel by a person's left hand holding the mandrel, while simultaneously pressing downward with the small finger and the adjacent finger and upwardly with the thumb.

While the embodiment of FIGS. 1–5 is described in connection with a fret 16 whose cross section, perpendicular to fret node 14 (FIG. 1), approximates two legs of a triangle, it is also applicable to frets (not shown), for instance, having a cross section, perpendicular to a fret node, that approximates a semicircular shape.

Figure 6:
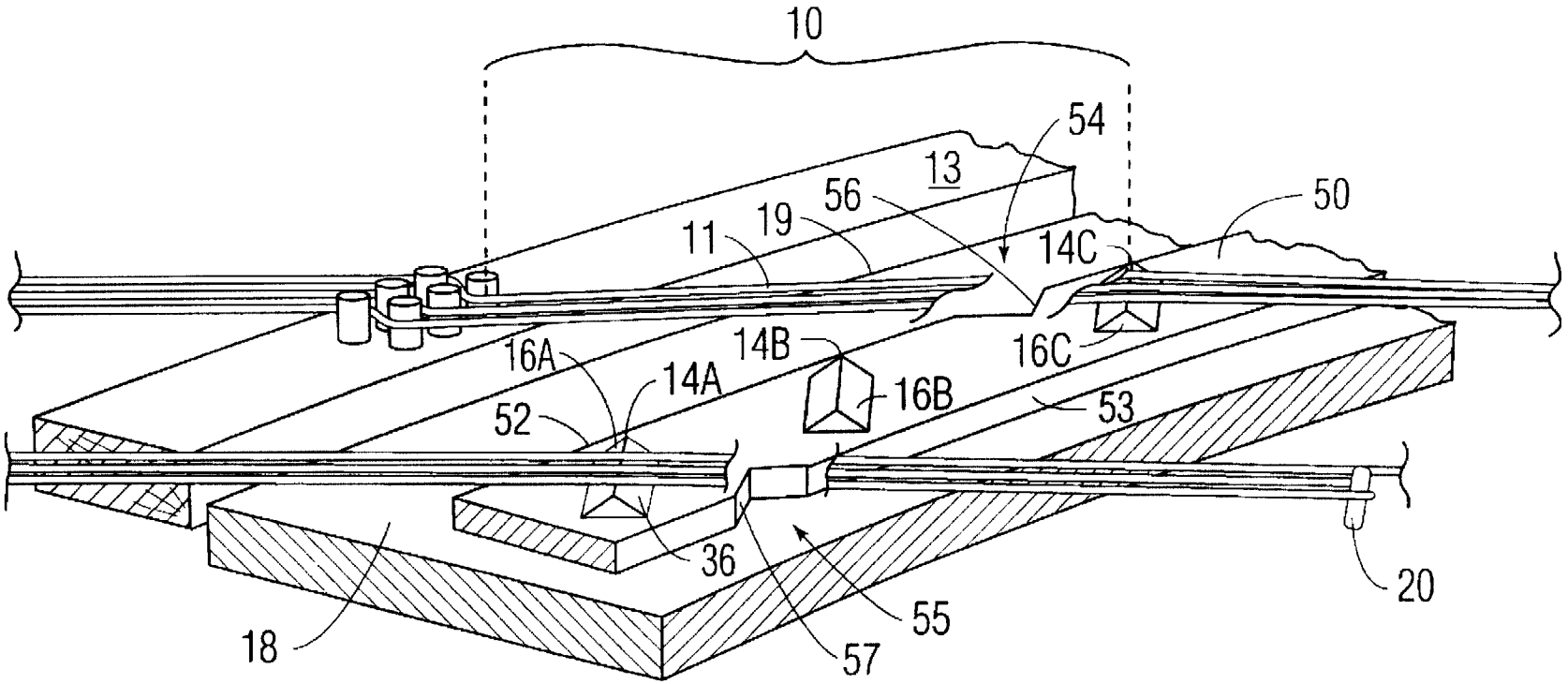
FIG. 6 is a top plan view of a rear duplex scale assembly equipped with a moveable fretbase on which are mounted multiple frets.

FIG. 6 is a top plan view of a rear moveable duplex scale assembly equipped with a moveable fretbase 50 on which are mounted multiple frets, which is alternatively known as a push-plate, harmonic bridge or secondary support. The individual frets 16A, 16B, 16C are fixed by casting on the surface of the fretbase. The fretbase is placed between the hitchpins 20 and the edge 19 of the cast iron plate 18, approximately parallel to the soundboard bridge 13. The apexes 14A, 14B 14C of the frets ideally remain perpendicular to the strings 11 when shortening or lengthening the duplex segment 10 of the string. The edges 52 and 53 of the fretbase 50 are at acute and obtuse angles to the strings, respectively, and, consequently, present no force-resistant surface to a force whose object is to move the fretbase toward the soundboard bridge 13 or toward the hitchpins 20. In order to remedy this difficulty and to provide the technician with the means to more easily accomplish the purpose of finely adjusting the moveable fretbases, L-shaped notches 54 and 55 may be cut, respectively, in the front edge 52 or the rear edge 53 of the fretbase prior to installation. These notches present force-receiving surfaces 56 and 57, which are parallel to the apex of the frets 14, perpendicular to the direction of the strings 11, and against which a fretbase-moving force may be transmitted. The placement of these L-shaped notches may vary according to the length and shape of the fretbases. Generally they are placed approximately midway along the length of the fretbase in such manner as to keep the fret nodes 14A, 14B and 14C perpendicular to the piano strings 11 as the fretbase moves parallel to the piano strings.

Figure 7:
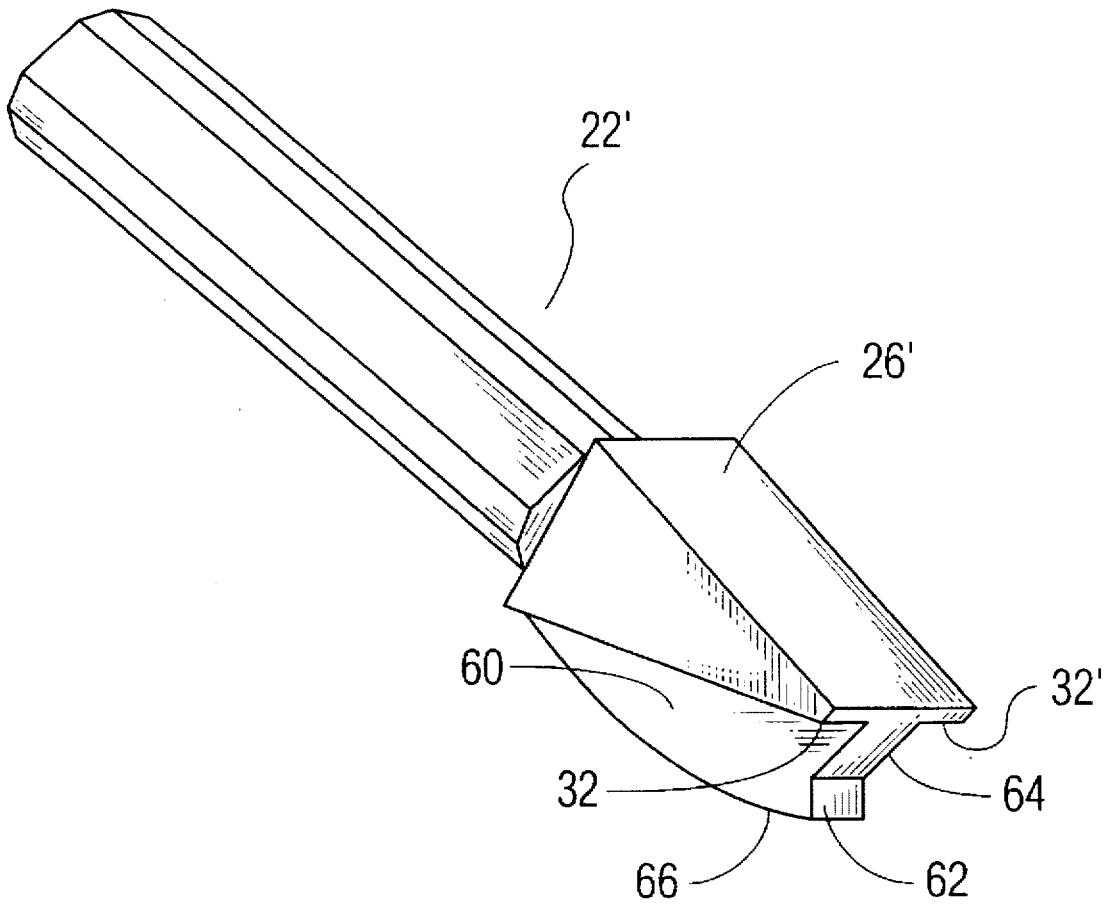
FIG. 7 is a perspective view of a modified sliding tool for moving multiple-fret duplex scale harmonic bridges.

FIG. 7 shows a modified sliding tool 22' for moving multiple-fret duplex scale harmonic bridges. A single or mono keel 60 may be centered between the shoulders 32 and 32', extending downward to contact the cast iron plate 18. The mono keel 60 must be sufficiently narrow to fit between two strings 11 of a unison and sufficiently wide to engage the force-receiving surface 56 or 57 of an L-shaped notch 54 or 55, and sufficiently high so that the shoulders 32 and 32' remain above the strings 11. When placed in position, the forward-most surface of the monokeel constitutes a perpendicular, horizontal force-transmitting surface 62. Surface 62 contacts the force-receiving surface 57 of the L-notch 54, transmitting the horizontal force component $F_H$ as previously described in connection with FIG. 1, to the moveable fretbase 50. Above the force-transmitting surface 62 is the slanted nose of the mono keel 64, which may or may not contact the inclined surface 36 of the raised fret. Directly behind the force-transmitting surface 62 is a sliding surface 66, which extends toward the rear of the monokeel 60 and angles upward to the rear of the head 26'.

Figure 9:
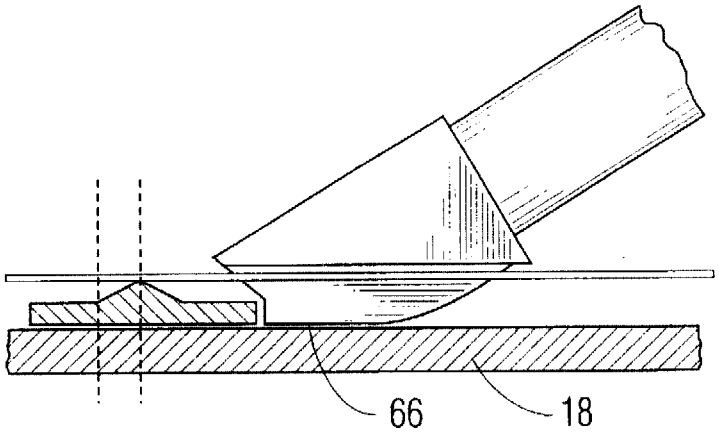
FIGS. 8 and 9 are side plan views in section of the sliding tool of FIG. 7, together with a moveable fretbase as shown in FIG. 6 and adjacent parts of a piano.
Figure 8:
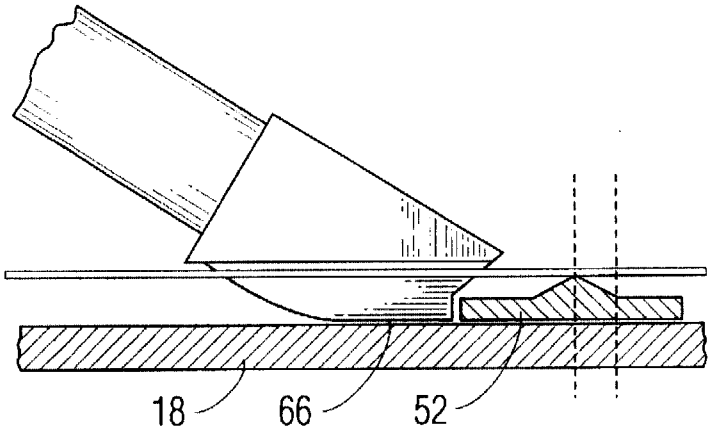

In FIGS. 8 and 9 the sliding surface 66 is flush with and parallel to the cast iron plate 18 for approximately half its length. As with the embodiment of FIGS. 1–5, the sliding surface 66 transfers a substantial portion of the downward vertical force component $F_V$ (FIG. 1) to the cast iron plate 18. A fretbase-moving force may be applied to the fretbase 50 to move it toward the hitchpin 20 (FIG. 6) as shown in FIG. 8, or towards the soundboard bridge 13 (FIG. 6) as shown in FIG. 9.

Figure 10:
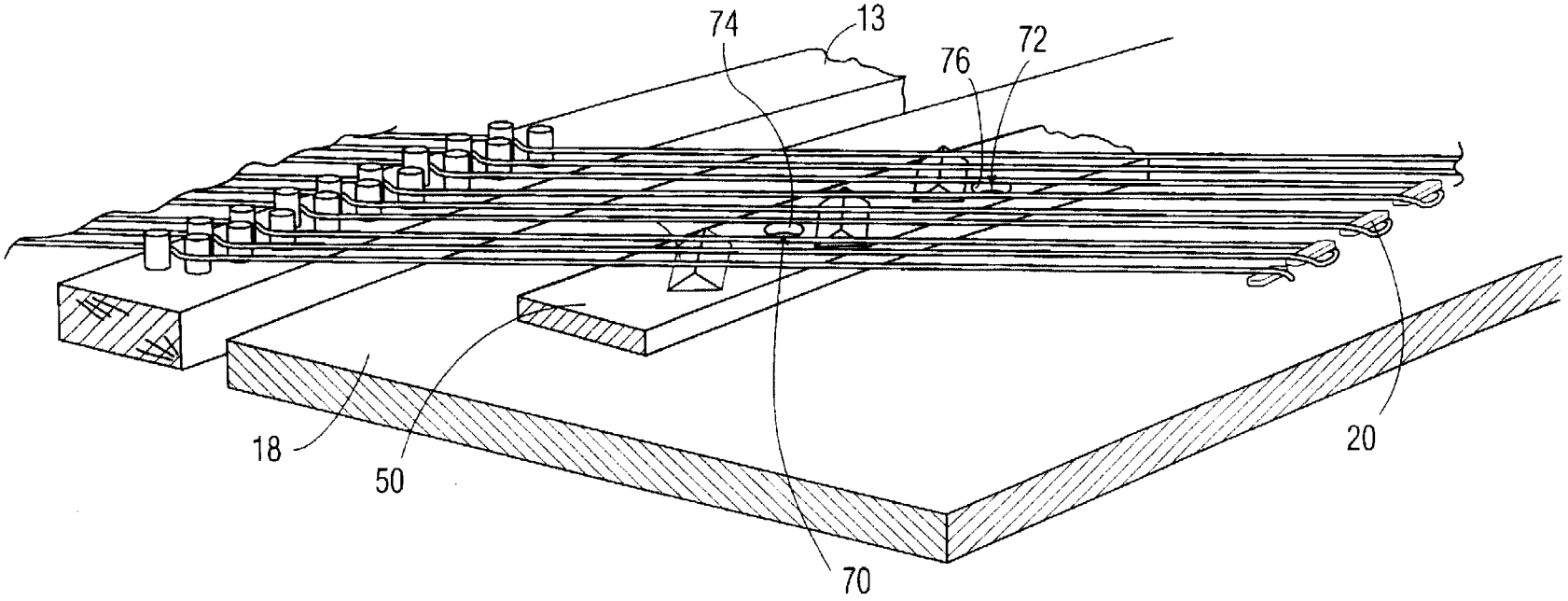
FIG. 10 is a top plan view of a rear duplex scale assembly equipped with a moveable fretbase containing circular apertures.
Figure 11:
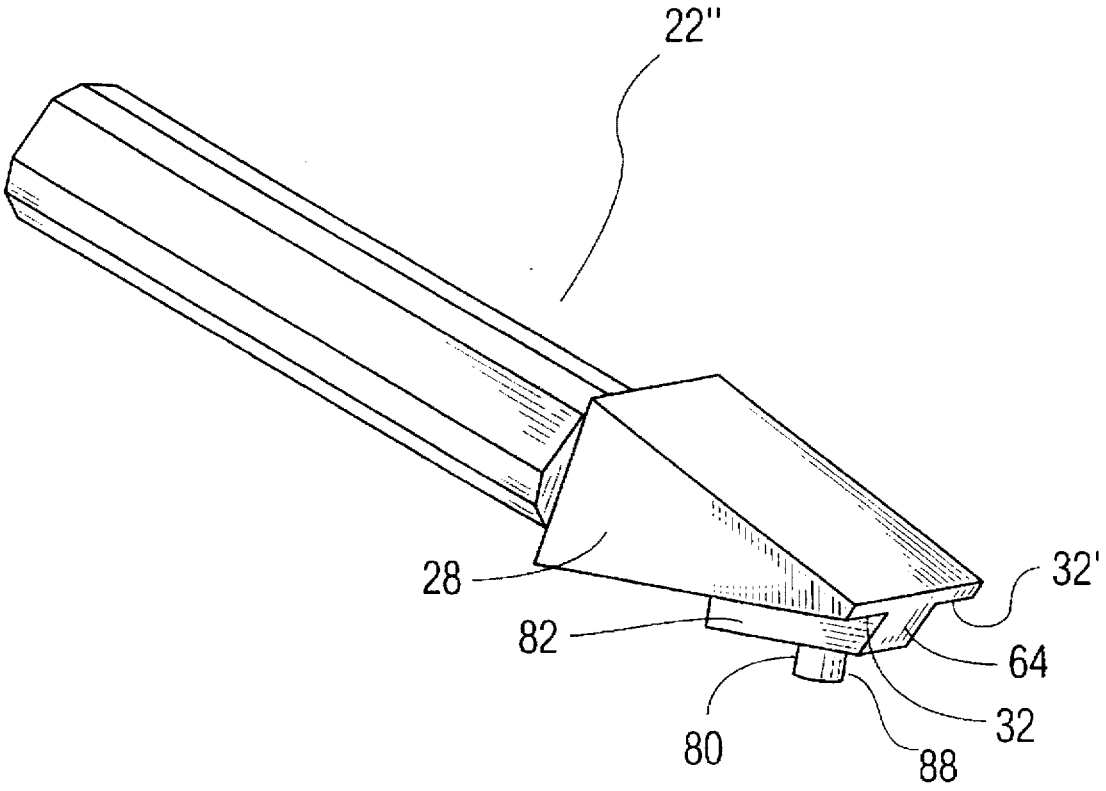
FIG. 11 is a perspective view of a sliding tool modified to have a keel pin.

FIG. 10 is a top plan view of a rear moveable duplex scale assembly equipped with a fretbase 50 having circular apertures 70 and 72 such as may be obtained by drilling through the fretbase before or after installation. Apertures 70 and 72 create respective force-receiving surfaces 74 and 76 on their circumferences, perpendicular to the direction of movement necessary to adjust the position of the fretbase 50. The fretbase 50 may be substantially the same as in FIG. 6 and the directions of movement required to properly move the fretbase the same. The circular apertures 70 and 72 enable a sliding tool 22", as shown in FIG. 11, modified to have a keel pin 80, to be inserted into them and a horizontal sliding force to be applied by the tool to the fretbase 50 to adjust its position. The placement of the circular apertures may vary according to the length and shape of the fretbases. Generally they are placed approximately midway along the length of the fretbase in such manner as to the keep the fret nodes perpendicular to the piano strings 11 as the fretbase moves parallel to the piano strings.

The steel keel pin 80 may be a round tubular shaped singular pin whose diameter is less than the distance between the strings 11 of a unison, enabling one end of the pin to be inserted from above into aperture 72 or 74 without touching the strings. The top of the pin is embedded in a supporting keel block 82 of steel or other force-resistant substance, which, in turn, is affixed to the bottom of the head 28 in the center, creating two shoulders 32 and 32'. The keel pin block 82 is slightly wider than the diameter of the pin to provide a pair of thin, lateral stabilizing walls (not numbered) between the sides of the pin and the sides of the block. The pin block 82 has strength-supporting portions (not numbered) behind and in front of the pin. Such portions support the pin and transfer the downward angular impulse force $F_I$ to the pin.

Figure 12:
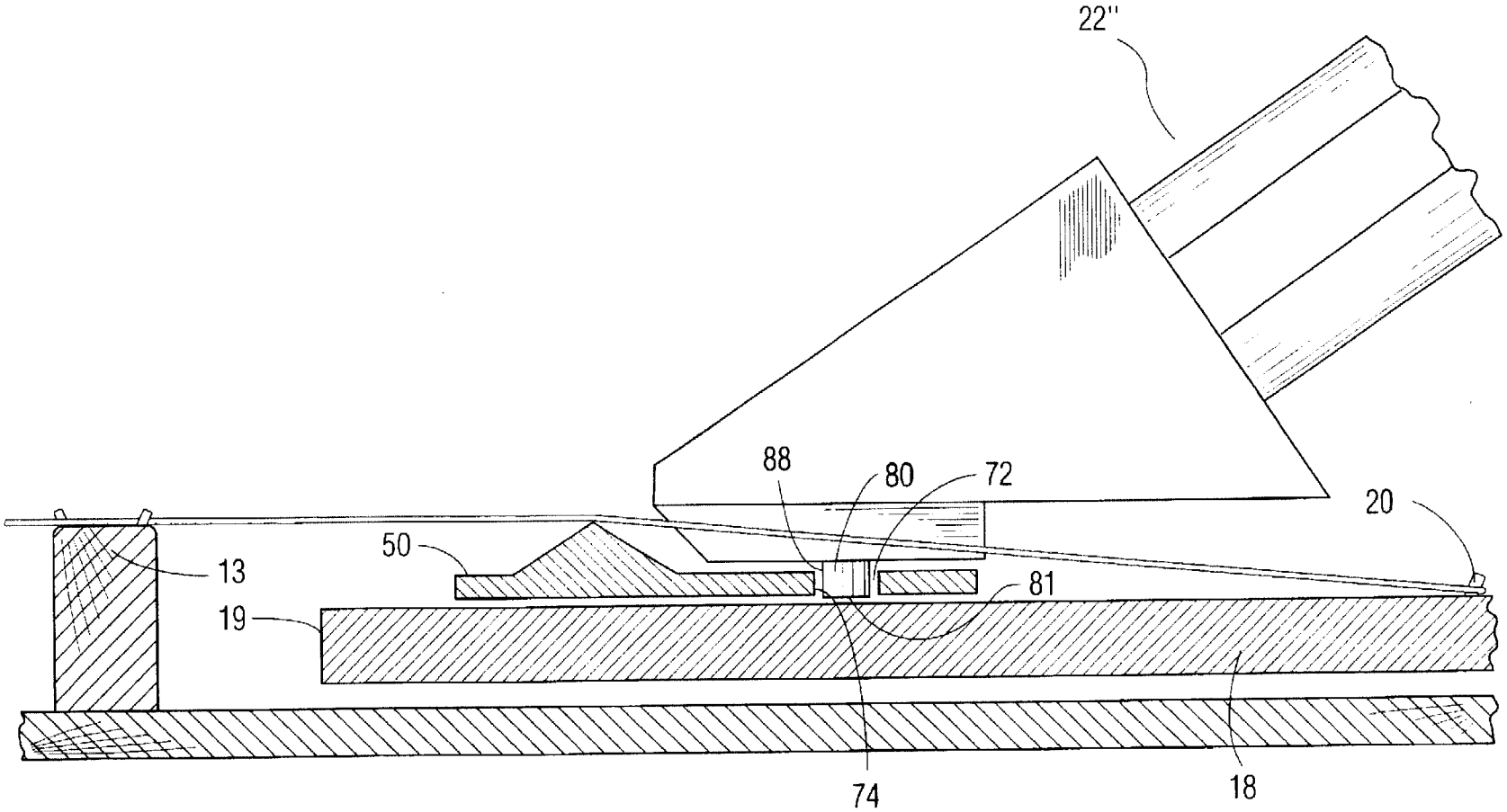
FIGS. 12 and 13 are side plan views in section of the sliding tool of FIG. 11, together with a moveable fretbase as shown in FIG. 10 and adjacent parts of a piano.
Figure 13:
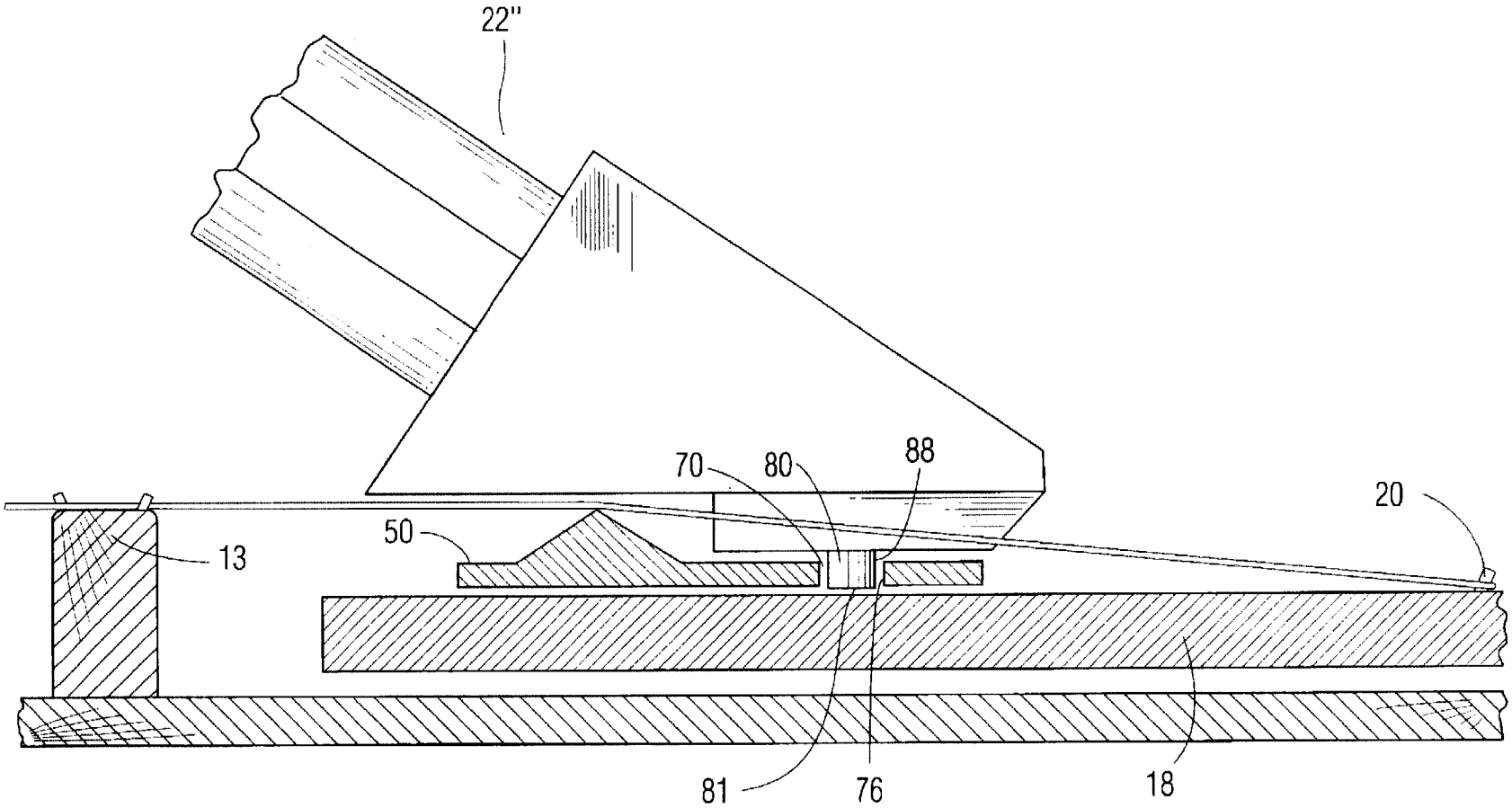

FIGS. 12 and 13 show the entire rear duplex tuning assembly with sliding tool 22" in position to adjust a fretbase 50 as shown in FIG. 10 having circular apertures 70 and 72. The pin 80 is inserted into the aperture so that the flat bottom sliding surface 81 of the pin 80 is flush with and in contact with the cast iron plate 18. The vertical force-transmitting surface of the pin 88 contacts the vertical force-receiving surface 74 or 76 of aperture 70 or 72. The keel pin block 86 fits between adjacent strings 11, allowing the bottom of the block to rest upon the surface of the moveable fretbase 50. Similar to the above-described embodiments, a substantial portion of the vertical force component $F_V$ (FIG. 1) is directed into cast iron plate 18 via the pin block 82 and the sliding surface of the pin 80, so that a substantial portion of the vertical force component $F_V$ is directed into the plate 18. Hence, the horizontal force transmitted by the force-transmitting surface of tool 22" to the force-receiving surface 74 or 76 of aperture 70 or 72 is significantly improved by the considerable reduction of frictional resistance to movement between the fretbase 50 and the cast iron plate 18.

Regarding the inclination of the various sliding tools 22, 22' and 22" described above with respect to the cast iron plate 18, respective preferred angles are 26°, 28° and 30°, all of which are desirably under about 30°. In the tools 22, 22' and 22", the heads (e.g., 28) preferably are made from hardened steel, while the mandrels (e.g., 24) are preferably made from brass. Moreover, the mandrels may be attached to the heads with a threaded steel screw (not shown) whose ends are respectively received into threaded holes in the mandrel and in the head. In the embodiments of FIGS. 6–13, employing a fretbase 50 on which multiple frets are mounted, it is desirable to loosen all but several piano strings to reduce the friction to movement between the fretbase and the underlying plate 18. It is desirable to relax the tension of downbearing pressure on all but several strings to reduce the friction between the fretbase and the underlying plate. The piano strings that are not relaxed are then tuned according to the invention.

While the invention has been described with respect to specific embodiments by way of illustration, many modifications and changes will occur to those skilled in the art. For instance, the above-described techniques apply to rebuilt pianos, as well as to newly built pianos. Further, while a technique for adjusting the rear duplex scale segment of piano strings is specifically described herein, the present technique can also be applied to the front duplex scale segment of piano strings. It is, therefore, to be understood that the appended claims are intended to cover all such modifications and changes as fall within the true scope and spirit of the invention.

What is claimed is:

1. In an acoustic piano having a fretbase on which at least one fret node is supported by a fret and an adjacent node spaced from said fret node; selected piano strings pressing downwardly upon said nodes and defining between said nodes a duplex scale portion of said piano strings; a plate beneath said fretbase and upon which said fretbase is pressed downwardly by said strings; the method of moving said fretbase portion relative to said plate in a direction parallel to said piano strings, comprising the steps of:

(a) providing a force-applying tool including a mandrel portion, and a force-transmitting head having a force-transmitting surface and a surface for sliding on said plate;

(b) orienting said tool so that a main axis of said mandrel portion angles downwardly towards a plane of said piano strings, with said force-transmitting surface abutting a force-receiving surface of said fretbase, and with said sliding surface abutting said plate;

(c) applying an impulse force along said main axis having a downward component orthogonal to said plane and a component horizontal to said plane; and (d) directing a sufficient amount of said downward component of force into said plate through said sliding surface so as to substantially reduce impulse force-caused friction between said fretbase and said plate.

2. The method of claim 1, further comprising the step of configuring said force-transmitting surface and said force-receiving surface so that the foregoing surfaces contact each other from a distance away from said plate substantially all the way to said plate.

3. The method of claim 1, further comprising the step of creating said force-receiving surface by forming a substantially enclosed aperture vertically through said fretbase.

4. The method of claim 3, wherein said enclosed aperture has a round cross section.

5. The method of claim 1, wherein said force-receiving surface is configured with respect to said force-transmitting surface so that said main axis is maintained substantially perpendicular to said fret when said force-transmitting surface is pressed against said force-receiving surface.

6. The method of claim 1, wherein a cross section of said fretbase surface, perpendicular to said fret, approximates two legs of a triangle.

7. In an acoustic piano having a fretbase on which at least one fret node is supported by a fret and an adjacent node spaced from said fret node; selected piano strings pressing downwardly upon said nodes and defining between said nodes a duplex scale portion of said piano strings; a plate beneath said fretbase and upon which said fretbase is pressed downwardly by said strings; the method of moving said fretbase portion relative to said plate in a direction parallel to said piano strings, comprising the steps of:

(a) creating a force-receiving surface vertically through said fretbase by forming vertically through said fretbase a non-enclosed aperture containing said force-receiving surface;

(b) providing a force-applying tool including a mandrel portion, and a force-transmitting head having a force-transmitting surface and a surface for sliding on said plate;

(c) orienting said tool so that a main axis of said mandrel portion angles downwardly towards a plane of said piano strings, with said force-transmitting surface abutting said force-receiving surface of said fretbase, and with said sliding surface abutting said plate;

(d) applying an impulse force along said main axis having a downward component orthogonal to said plane and a component horizontal to said plane; and (e) directing a sufficient amount of said downward component of force into said plate through said sliding surface so as to substantially reduce impulse force-caused friction between said fretbase and said plate.

8. The method of claim 7, further comprising the step of configuring said force-transmitting surface and said force-receiving surface so that the foregoing surfaces contact each other from a distance away from said plate substantially all the way to said plate.

9. The method of claim 7, wherein said force-receiving surface is configured with respect to said force-transmitting surface so that said main axis is maintained substantially perpendicular to said fret when said force-transmitting surface is pressed against said force-receiving surface.

10. The method of claim 9, wherein said non-enclosed aperture comprises an L-shaped notch.

11. The method of claim 7, wherein said force-receiving surface is configured with respect to said force-transmitting surface so that said main axis is maintained substantially perpendicular to said fret when said force-transmitting surface is pressed against said force-receiving surface.

12. In an acoustic piano comprising a fretbase on which at least one fret node is supported by a fret and an adjacent node spaced from said fret node; selected piano strings pressing downwardly upon said nodes and defining between said nodes a duplex scale portion of said piano strings; and a plate beneath said fretbase and upon which said fretbase is pressed downwardly by said strings; the method steps of:

(a) contouring said fretbase to facilitate its movement by forming a vertically oriented aperture containing a force-receiving surface for receiving a force effective to move said fretbase relative to said plate; and (b) applying said force on said force-receiving surface of said aperture to move said fretbase relative to said plate.

13. The piano of claim 12, wherein said aperture is configured to be non-enclosed.

14. The piano of claim 13, wherein said non-enclosed aperture comprises an L-shaped notch having a force-receiving surface oriented perpendicular to said piano strings.

* * * * *